US011400484B2

(12) United States Patent
Kuo et al.

(10) Patent No.: US 11,400,484 B2
(45) Date of Patent: Aug. 2, 2022

(54) FAN BLADE AND FABRICATING METHOD THEREOF

(71) Applicant: HTC Corporation, Taoyuan (TW)

(72) Inventors: Chih-Yao Kuo, Taoyuan (TW); Chin-Kai Sun, Taoyuan (TW); Chung-Chiao Tan, Taoyuan (TW)

(73) Assignee: HTC Corporation, Taoyuan (TW)

( * ) Notice: Subject to any disclaimer, the term of this patent is extended or adjusted under 35 U.S.C. 154(b) by 0 days.

(21) Appl. No.: 17/073,418

(22) Filed: Oct. 19, 2020

(65) Prior Publication Data

US 2022/0120284 A1 Apr. 21, 2022

(51) Int. Cl.

| | |
|---|---|
| ***B05D 1/12*** | (2006.01) |
| ***F04D 29/28*** | (2006.01) |
| ***B05D 3/00*** | (2006.01) |

(52) U.S. Cl.

CPC ..... *B05D 1/12* (2013.01); *B05D 3/002* (2013.01); *B05D 3/007* (2013.01); *F04D 29/281* (2013.01); *F05D 2230/90* (2013.01); *F05D 2300/516* (2013.01); *F05D 2300/611* (2013.01)

(58) Field of Classification Search

None

See application file for complete search history.

(56) References Cited

U.S. PATENT DOCUMENTS

| | | | | |
|---|---|---|---|---|
| 2003/0021089 | A1* | 1/2003 | Belady | F04D 29/38 361/695 |
| 2003/0049451 | A1* | 3/2003 | Stay | B05D 1/045 428/411.1 |
| 2006/0115362 | A1 | 6/2006 | Wobben | |
| 2019/0101002 | A1 | 4/2019 | Duffin et al. | |

FOREIGN PATENT DOCUMENTS

| | | |
|---|---|---|
| CN | 2451783 | 10/2001 |
| CN | 101377006 | 3/2012 |
| CN | 107269579 | 10/2017 |
| CN | 109801734 | 5/2019 |

OTHER PUBLICATIONS

"Office Action of Taiwan Counterpart Application", dated Mar. 24, 2021, p. 1-p. 5.

"Office Action of Taiwan Counterpart Application", dated Nov. 16, 2021, p. 1-p. 5.

* cited by examiner

*Primary Examiner* — Michael P. Rodriguez

(74) *Attorney, Agent, or Firm* — JCIPRNET

(57) ABSTRACT

A fan blade and a fabricating method thereof are provided. The fan blade includes a rough coating layer on a surface thereof. The rough coating layer includes a plurality of recessed regions. A maximum depth of recess of the recessed regions is between 50 μm to 130 μm.

1 Claim, 2 Drawing Sheets

FAN BLADE AND FABRICATING METHOD THEREOF

BACKGROUND

Technical Field

This application relates to a fan blade and a fabricating method thereof, and particularly relates to a fan blade having a rough coating layer on its surface and a fabricating method thereof.

Description of Related Art

As science and technology constantly advance, various electronic products are developing faster. Among them, for example, mobile phones, head-mounted display devices, etc., generate relatively more heat during operation since their functions are powerful. Therefore, how to improve heat dissipation efficiency of electronic devices to maintain normal operation and prevent users from experiencing a high temperature is an important direction for research and development.

SUMMARY

This application provides a fan blade and a fabricating method thereof, which may solve the problem of poor heat dissipation efficiency of electronic devices.

The fan blade of this application includes a rough coating layer on its surface. The rough coating layer includes a plurality of recessed regions. A maximum depth of recess of the recessed regions is between 50 micrometers (μm) and 130 μm.

A fabricating method of a fan blade of this application includes the following steps. A fan blade is provided. A rough coating layer is formed on a surface of the fan blade. The rough coating layer is formed to include a plurality of recessed regions. A maximum depth of recess of the recessed regions is between 50 μm and 130 μm.

Based on the foregoing, in the fan blade and the fabricating method thereof in this application, the heat dissipation efficiency may be improved due to the rough coating layer on the surface.

DESCRIPTION OF THE EMBODIMENTS

Figure 1:
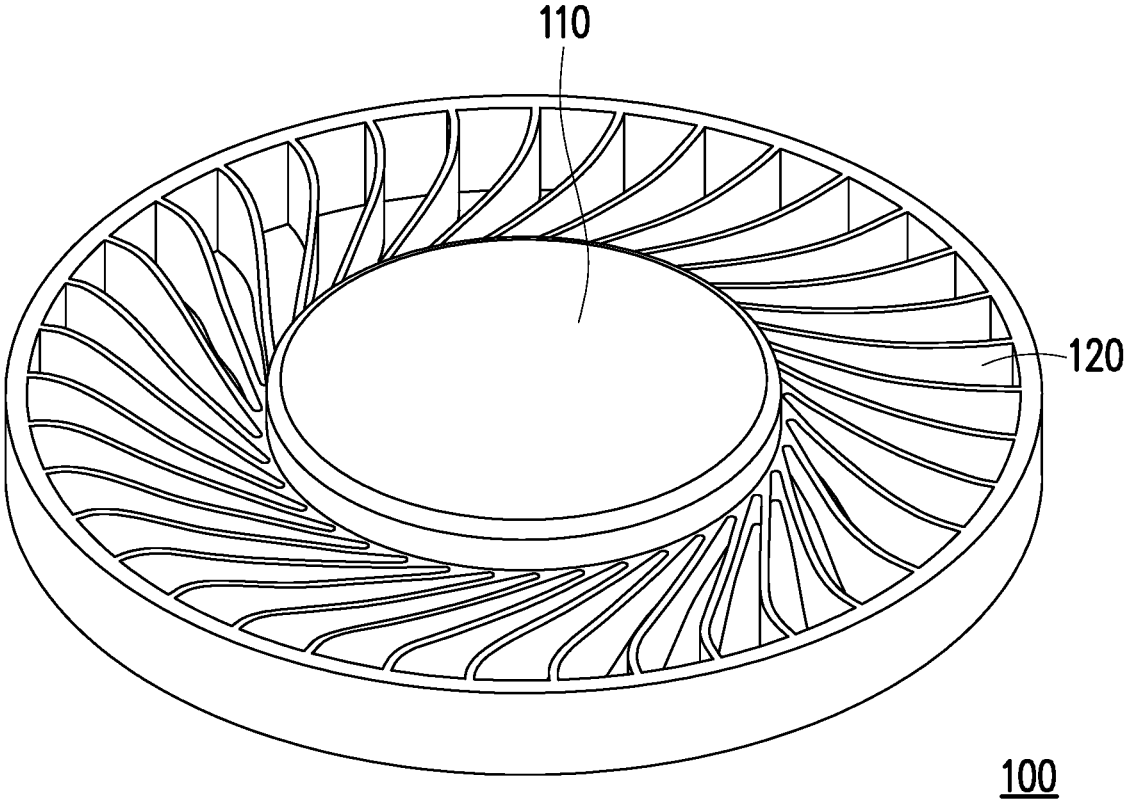
FIG. 1 is a schematic diagram of a fan blade according to an embodiment of this invention.

FIG. 1 is a schematic diagram of a fan blade according to an embodiment of this invention. Referring to FIG. 1, for the appearance of a fan blade 100 in this embodiment, a fan blade of a general centrifugal fan is taken as an example, which includes a hub 110 and a plurality of blades 120 connected to a periphery of the hub 110. However, the fan blade of this application is not limited to this type, and may be a blade of other types of fans besides a centrifugal fan.

Figure 2:
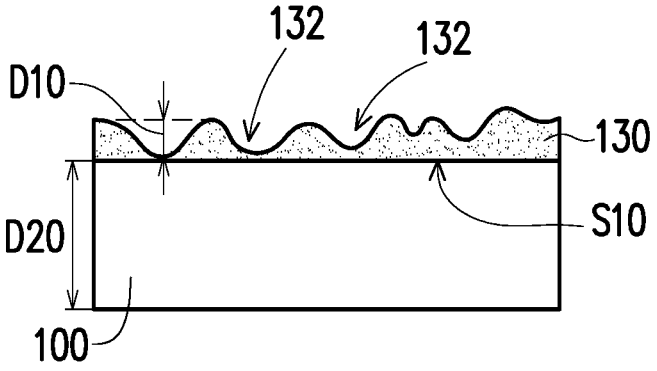
FIG. 2 is a schematic partial cross-sectional view of the fan blade of FIG. 1.

FIG. 2 is a schematic partial cross-sectional view of the fan blade of FIG. 1. Referring to FIG. 2, the cross section shown herein may be of the hub 110, the blade 120, or other parts of the fan blade 100. The fan blade 100 includes a rough coating layer 130 on a surface S10. In other words, the rough coating layer 130 may be a surface located on the hub 110, the blade 120, or other parts of the fan blade 100. The rough coating layer 130 includes a plurality of recessed regions 132. A maximum depth of recess D10 of the recessed regions 132 is between 50 μm and 130 μm.

The rough coating layer 130 allows the air flowing through the surface S10 of the fan blade 100 to form a turbulent boundary layer in close contact with the surface S10, so that the airflow outside the turbulent boundary layer travels backward slightly further along the surface S10 of the fan blade 100 to reduce the range of the wake flow that causes a drag force. In this way, parameters such as a flow rate and a wind pressure generated by the fan blade 100 can be increased, and noise volume generated can be reduced.

In this embodiment, an arithmetic mean roughness (Ra) of the rough coating layer 130 is between 1.9 μm and 5.9 μm, but this application is not limited thereto.

In this embodiment, an average depth of recess of the recessed regions 132 is between 35 μm and 65 μm, but this application is not limited thereto.

Figure 3:
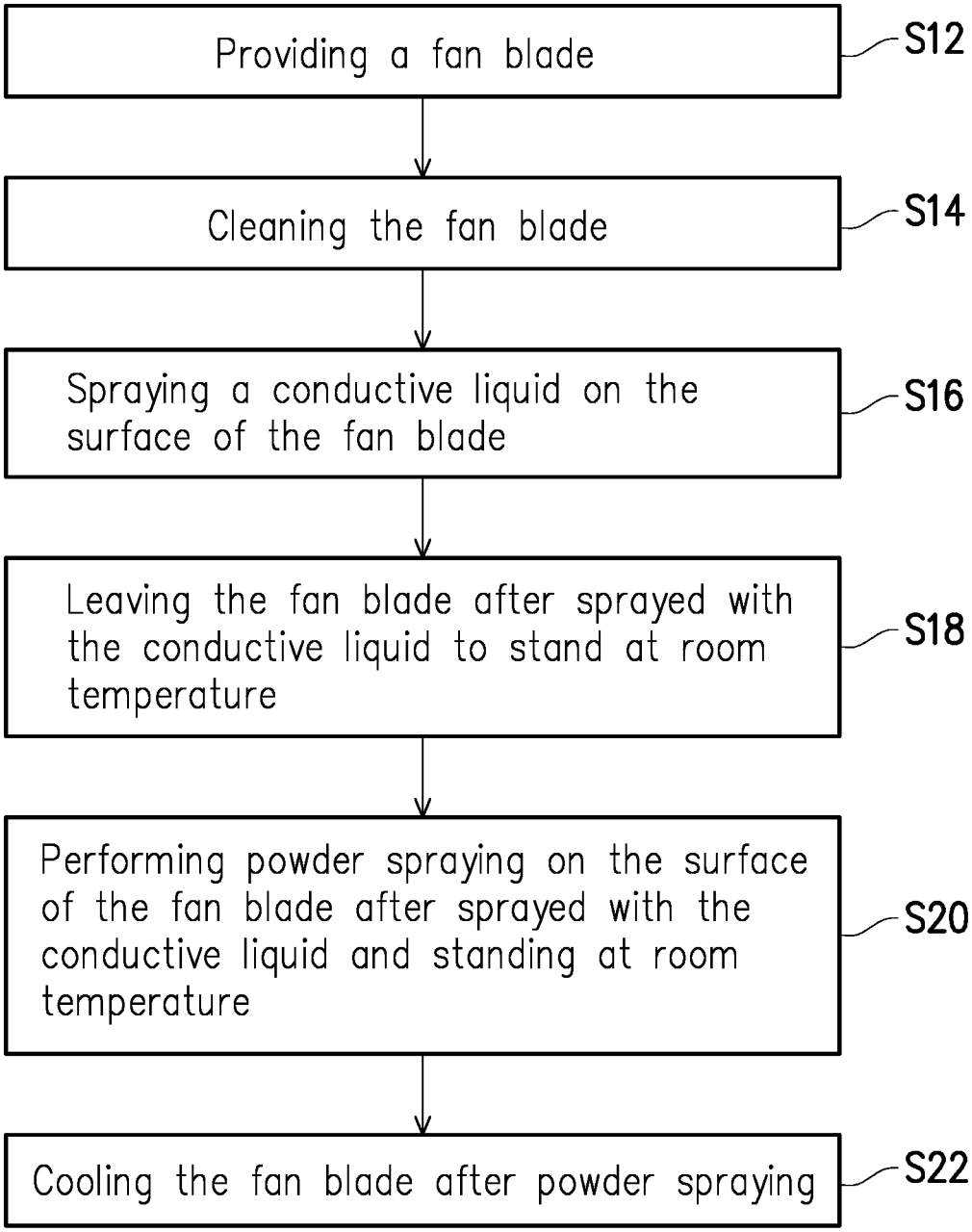
FIG. 3 is a flowchart of a fabricating method of a fan blade according to an embodiment of this invention.

FIG. 3 is a flowchart of a fabricating method of a fan blade according to an embodiment of this invention. Referring to FIG. 2 and FIG. 3, the fabricating method of the fan blade of this embodiment includes the following steps. A fan blade is provided, step S12. A rough coating layer 130 is formed on a surface of the fan blade 100. The rough coating layer 130 is formed to include a plurality of recessed regions 132. As aforementioned, a maximum depth of recess D10 of the recessed regions 132 is between 50 μm and 130 μm. In this embodiment, the rough coating layer 130 is a powder coating layer, and the method of forming the rough coating layer 130 includes powder coating, but this application is not limited thereto.

In an embodiment of this application, the method of forming a rough coating layer includes the following steps. For example, the surface of the fan blade 100 is cleaned up first, step S14. Next, a conductive liquid is sprayed on the surface of the fan blade 100, step S16. Afterward, the fan blade 100 after sprayed with the conductive liquid is left to stand at room temperature for about 30 minutes, step S18. Then, the fan blade 100 after sprayed with the conductive liquid and standing at room temperature is hung, and powder spraying is performed on the surface of the fan blade 100, step S20. The spraying temperature is about 200° C., and the spraying time is about 30 minutes. Afterward, the fan blade 100 after powder spraying is cooled, step S22. The material of the sprayed powder includes, for example, polyester and epoxy resin, and the particle size thereof is, for example, between 30 μm and 34 μm. The powder coating technology is more environmentally friendly, and the material utilization rate is better.

In this embodiment, the maximum depth of recess D10 of the recessed regions 132 is greater than 10% of a thickness D20 of the fan blade.

Table 1 below lists the results obtained by adopting a fan with a rough coating layer according to an embodiment of this application and a conventional fan without a rough coating layer for test. Between them, the diameter of the fan is 36 mm, the thickness of the fan blade is 0.3 mm, and the overall thickness of the fan is 5.5 mm. The unit of flow rate is CMF (cubic foot per minute), the unit of wind pressure is millimeter-water column (mm-Aq), and the unit of noise is dB. In the tests of No. A and No. B, the rotation speed of the fan is the same, and the rotation speed of the fan of No. C is higher. As can be seen from Table 1, when the rotation speed of the fan is the same, greater flow rate and wind pressure are generated by the fan with the rough coating layer than by the fan without the rough coating layer, and less noise is generated by the fan with the rough coating layer than by the fan without the rough coating layer. Besides, in the experiments No. A and No. C, the noise generated by the fan with the rough coating layer is similar to the noise generated by the fan without the rough coating layer, the flow rate generated by the fan with the rough coating layer can be increased by 7% compared with the flow rate generated by the fan without the rough coating layer, and the wind pressure also shows an 11.7% increase.

TABLE I

| No. | Fan blade | Flow rate (CFM) | Wind pressure (mm-Aq) | Noise (dB) |
|---|---|---|---|---|
| A | Without rough coating layer | 2.82 | 19.7 | 38.13 |
| B | With rough coating layer | 2.84 | 20.0 | 36.89 |
| C | With rough coating layer | 3 | 22.0 | 38.0 |

In summary of the foregoing, in the fan blade and the fabricating method thereof in this application, the rough coating layer results in the plurality of recessed regions on the surface of the fan blade, thus reducing the drag force experienced during operation. In this way, the flow rate and the wind pressure generated by the fan blade can both be increased to improve the heat dissipation efficiency, and the noise volume generated can also be reduced.

What is claimed is:

1. A fabricating method of a fan blade, comprising:

providing a fan blade;

forming a rough coating layer on a surface of the fan blade, wherein the rough coating layer is formed to comprise a plurality of recessed regions, a maximum depth of recess of the recessed regions is between 50 μm and 130 μm, and the maximum depth of recess of the recessed regions is greater than 10% of a thickness of the fan blade, wherein a method of forming the rough coating layer comprises performing powder coating, and the method of forming the rough coating layer comprises:

cleaning the fan blade;

spraying a conductive liquid on the surface of the fan blade;

leaving the fan blade sprayed with the conductive liquid to stand at room temperature;

performing powder spraying on the surface of the fan blade sprayed with the conductive liquid and standing at room temperature; and cooling the fan blade after powder spraying.

* * * * *